US010370879B2

(12) United States Patent
Tomaszewski

(10) Patent No.: US 10,370,879 B2
(45) Date of Patent: Aug. 6, 2019

(54) DOOR LATCH WITH FAST UNLOCK

(71) Applicant: Magna Closures Inc., Newmarket (CA)

(72) Inventor: Kris Tomaszewski, Newmarket (CA)

(73) Assignee: MAGNA CLOSURES INC., Newmarket (CA)

( * ) Notice: Subject to any disclaimer, the term of this patent is extended or adjusted under 35 U.S.C. 154(b) by 1099 days.

(21) Appl. No.: 14/691,670

(22) Filed: Apr. 21, 2015

(65) Prior Publication Data

US 2015/0308163 A1 Oct. 29, 2015

Related U.S. Application Data

(60) Provisional application No. 61/984,234, filed on Apr. 25, 2014.

(51) Int. Cl.

| | |
|---|---|
| ***E05B 85/20*** | (2014.01) |
| ***E05B 77/28*** | (2014.01) |
| ***E05B 81/06*** | (2014.01) |
| ***E05B 81/16*** | (2014.01) |
| ***E05B 81/34*** | (2014.01) |

(Continued)

(52) U.S. Cl.

CPC ..... *E05B 85/20* (2013.01); *E05B 77/28* (2013.01); *E05B 77/32* (2013.01); *E05B 81/06* (2013.01); *E05B 81/16* (2013.01); *E05B 81/34* (2013.01); *E05B 81/36* (2013.01)

(58) Field of Classification Search

CPC ..... E05B 77/32; E05B 77/28; E05B 81/06; E05B 81/16; E05B 81/34; E05B 81/36; E05B 85/20; Y10T 292/0823; Y10T 292/0843; Y10T 292/0856; Y10T 292/0966; Y10T 292/0993; Y10T 292/1018; Y10T 292/1021; Y10T 292/1078; Y10T 292/1079; Y10T 292/1082; Y10T 292/307; Y10T 292/308; Y10T 292/1047; Y10S 292/23

USPC ..... 292/22, 39, 51, 160, 172, 142, 144, 198, 292/199, 201, 279, 280, 216, DIG. 23

See application file for complete search history.

(56) References Cited

U.S. PATENT DOCUMENTS 4,093,289 A * 6/1978 Inabayashi ..... E05B 81/25 292/201
4,793,640 A * 12/1988 Stewart, Sr. ..... E05B 81/25 292/199

(Continued)

FOREIGN PATENT DOCUMENTS

CN 101184900 A 5/2008
CN 101657590 A 2/2010

(Continued)

OTHER PUBLICATIONS

Search Report from corresponding Chinese Patent Application No. 1201510202997.3.

*Primary Examiner* — Christine M Mills
(74) *Attorney, Agent, or Firm* — Dickinson Wright PLLC

(57) ABSTRACT

A closure latch assembly for a vehicle door comprising a lock link operatively connected to a ratchet is provided. The latch assembly is configured to quickly move the lock link to an unlocking position and thus the ratchet to an open position when a user activates a motor of the latch assembly, for example using a key fob. Thus, an impatient passenger can quickly open the door, even while other components of the latch assembly are still moving toward their respective unlocking positions.

13 Claims, 8 Drawing Sheets

(51) Int. Cl.
*E05B 81/36* (2014.01)
*E05B 77/32* (2014.01)

(56) References Cited

U.S. PATENT DOCUMENTS 4,904,006 A * 2/1990 Hayakawa ..... E05B 81/06 292/201
7,261,333 B2 * 8/2007 Tomaszewski ..... E05B 81/06 292/201
8,172,283 B2 * 5/2012 Takahashi ..... E05B 77/28 292/201
8,522,583 B2 9/2013 Cumbo et al.
9,046,439 B2 * 6/2015 Taurasi, I ..... G01M 17/00
9,353,556 B2 * 5/2016 Margheritti ..... E05B 77/34
9,476,230 B2 * 10/2016 Margheritti ..... E05B 77/34
2007/0220934 A1 * 9/2007 Chevalier ..... E05B 81/14 70/237
2008/0224482 A1 * 9/2008 Cumbo ..... E05B 77/02 292/216
2010/0207400 A1 8/2010 Tomaszewski et al.
2011/0074166 A1 * 3/2011 Taurasi ..... E05B 81/14 292/27

FOREIGN PATENT DOCUMENTS

DE 102011012369 A1 8/2011
EP 0632178 A1 1/1995
EP 2112306 A2 * 10/2009 ..... E05B 77/26
GB 2337295 A 11/1999
GB 2400408 A 10/2004
WO 2008104040 A1 9/2008
WO WO2009046539 A1 4/2009

* cited by examiner

DOOR LATCH WITH FAST UNLOCK

CROSS REFERENCE TO RELATED APPLICATIONS

This application claims the benefit of U.S. Provisional Patent Application Ser. No. 61/984,234 filed on Apr. 25, 2014, the entire disclosure of which is hereby incorporated by reference.

BACKGROUND OF THE INVENTION

1. Field of the Invention

The present invention relates to a closure latch assembly for a vehicle door, and more particularly to a closure latch equipped with a passive entry feature.

2. Related Art

This section provides background information related to the present disclosure which is not necessarily prior art.

Passive entry features are provided on some vehicles to permit a vehicle user who is in possession of the vehicle key to simply pull the door handle and open the door without the need to introduce the key into a keyhole in the door. The key is associated with a key fob equipped with an electronic device that communicates with the vehicle's on-board control system to authenticate the user. The user, or an impatient passenger traveling with the user, typically wants the door to unlock instantaneously, so that he or she does not have to wait before being permitted to open the door.

Some door latches include features, such as, for example, a "fast unlock" or "impatient passenger" feature, which permit the latch to unlock, even when the impatient passenger lifts the door handle prior to actuation of a motor driving the latch. Example door latch systems which provide for quick entry to a vehicle are described in U.S. Provisional Patent Application No. 61/161,193; U.S. Patent Application Publication No. 2010/0207400; U.S. Pat. No. 8,522,583; and International Patent Application Publication No. WO 2009/046539, the disclosures of which are hereby incorporated by reference in their entireties. However, known solutions to improving unlock speed generally require multiple motors, or large motors capable of providing high torque, which leads to high cost and complexity.

SUMMARY

This section provides a general summary of the disclosure and is not a comprehensive disclosure of its full scope or all of its aspects and features. Further areas of applicability will become apparent from the description provided herein. The description and specific examples in this summary are not intended to limit the scope of the inventive concepts disclosed herein.

According to an aspect of the disclosure, a latch assembly is provided for use with a striker and a lock knob assembly within a vehicle. The latch assembly includes a ratchet that is moveable between a closed position in which the striker is retained within the latch and an open position in which the ratchet releases the striker from the ratchet. A link is operatively coupled to the ratchet and is movable between a lock position which holds the ratchet in the closed position, and an unlocked position which allows the ratchet to move to the open position. An inside lock lever is operatively coupled to the ratchet and rotatable between a door lock position and a door unlock position for connecting to the lock knob assembly for moving the lock knob assembly and the ratchet in response to rotation of the inside lock lever. A transfer assembly interconnects the link and the inside lock lever. The transfer assembly includes a first gear that is rotatable, has a first radius and is connected to the link for providing the movement of the link. The transfer assembly also includes a second gear that is rotatable, has a second radius and is connected to the inside lock lever for providing the movement of the inside lock lever. The second radius of the second gear is larger than the first radius of the first gear for rotating the first gear at a higher speed and with lower torque than the second gear to quickly move the link, and for rotating the second gear at a lower speed and with higher torque than the first gear to forcefully move the inside lock lever.

According to another aspect of the disclosure, a single, relatively small actuator can be utilized to move the link and inside lock lever of the latch assembly because of the favorable gear ratio between the first and second gears. More specifically, the power lock motor only needs to produce a fraction of the torque that would otherwise be required if the link were required to be moved completely and simultaneously with the inside lock lever. Accordingly, the latch assembly comprises few parts, is simple in design and inexpensive to manufacture.

DRAWINGS

The drawings described herein are for illustrative purposes only of selected embodiments and are not intended to limit the scope of the present disclosure. The inventive concepts will be more readily understood by reference to the following description in combination with the accompanying drawings, where:

Figure 1A:
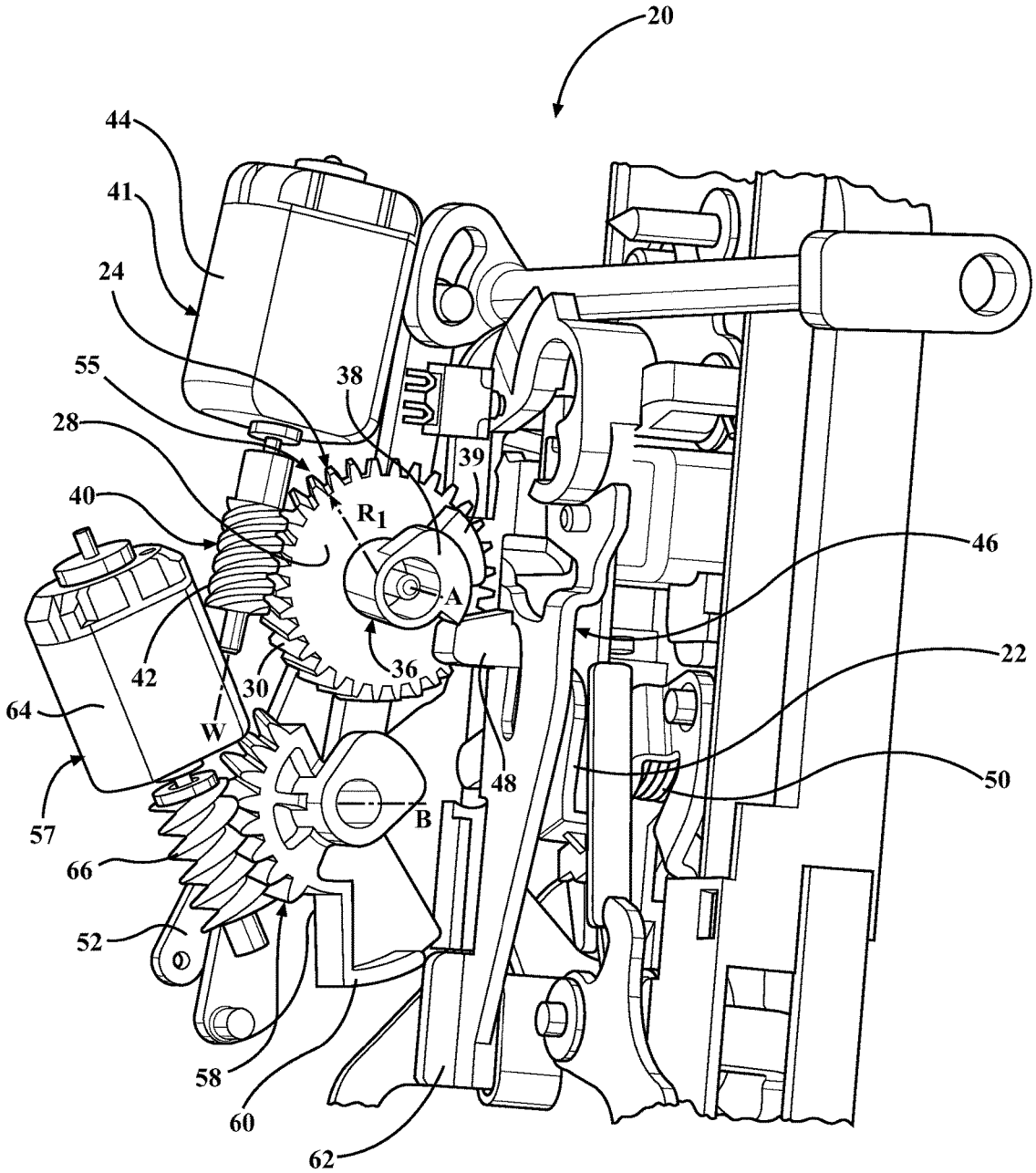
FIGS. 1A and 1B are perspective views of a latch assembly for a vehicle door in accordance with an example embodiment, including an intermittent link, a lock link, and an inside lock lever.
Figure 1B:
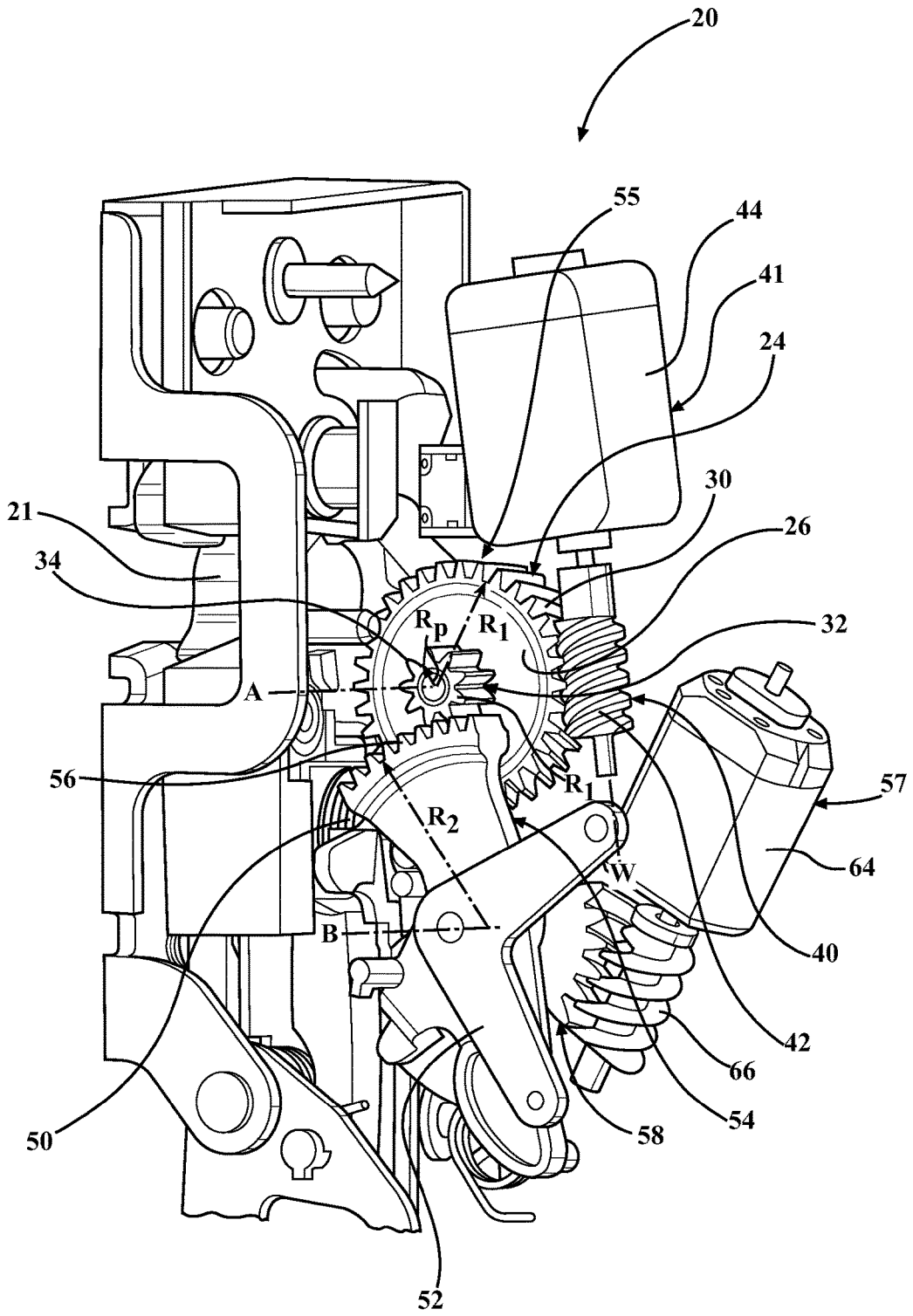
Figure 2A:
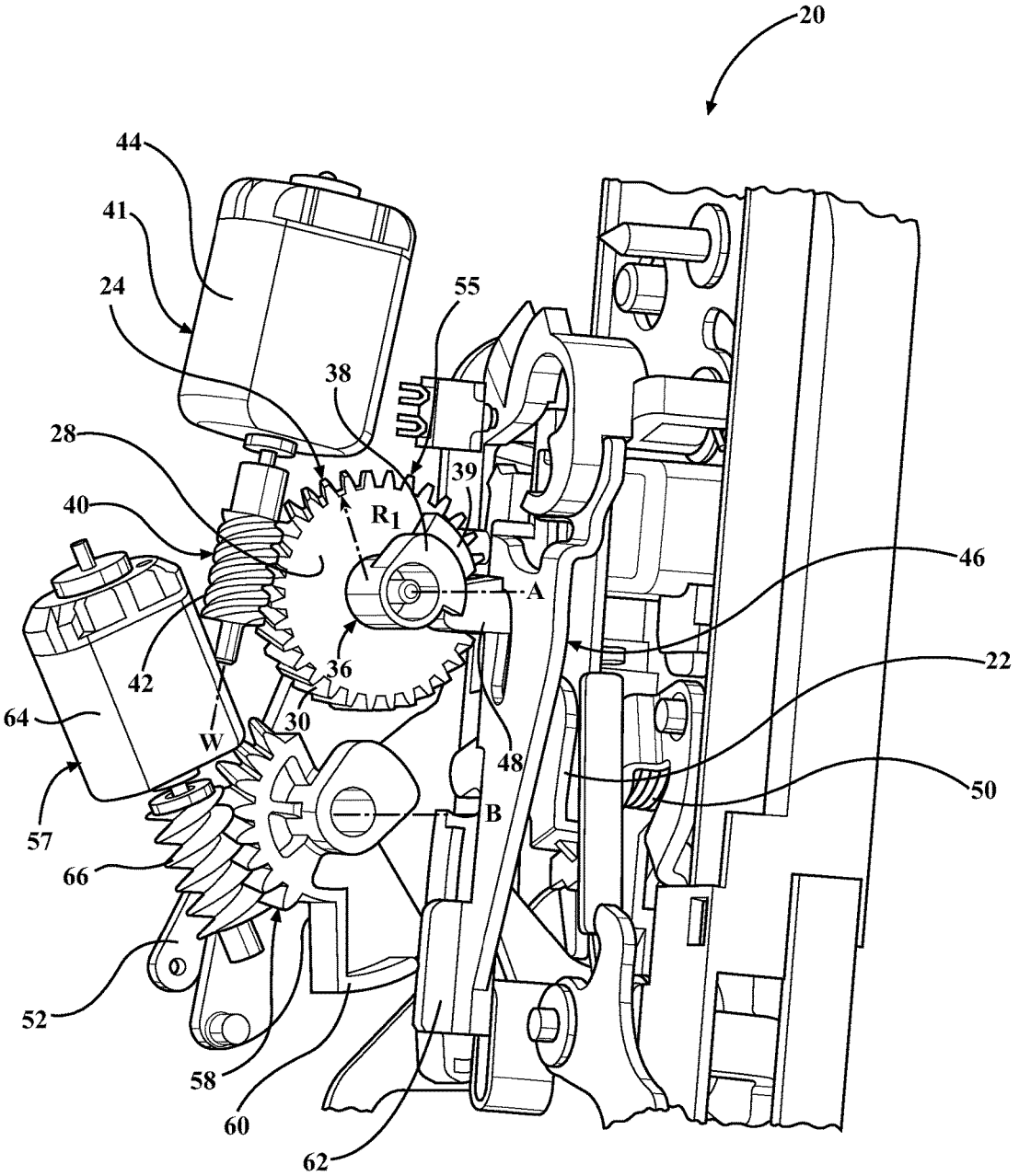
FIGS. 2A and 2B are perspective views of the latch assembly of FIGS. 1A and 1B, showing the intermittent link in an unlocked position, the lock link in an unlocking position, and the inside lock lever in a door lock position.
Figure 2B:
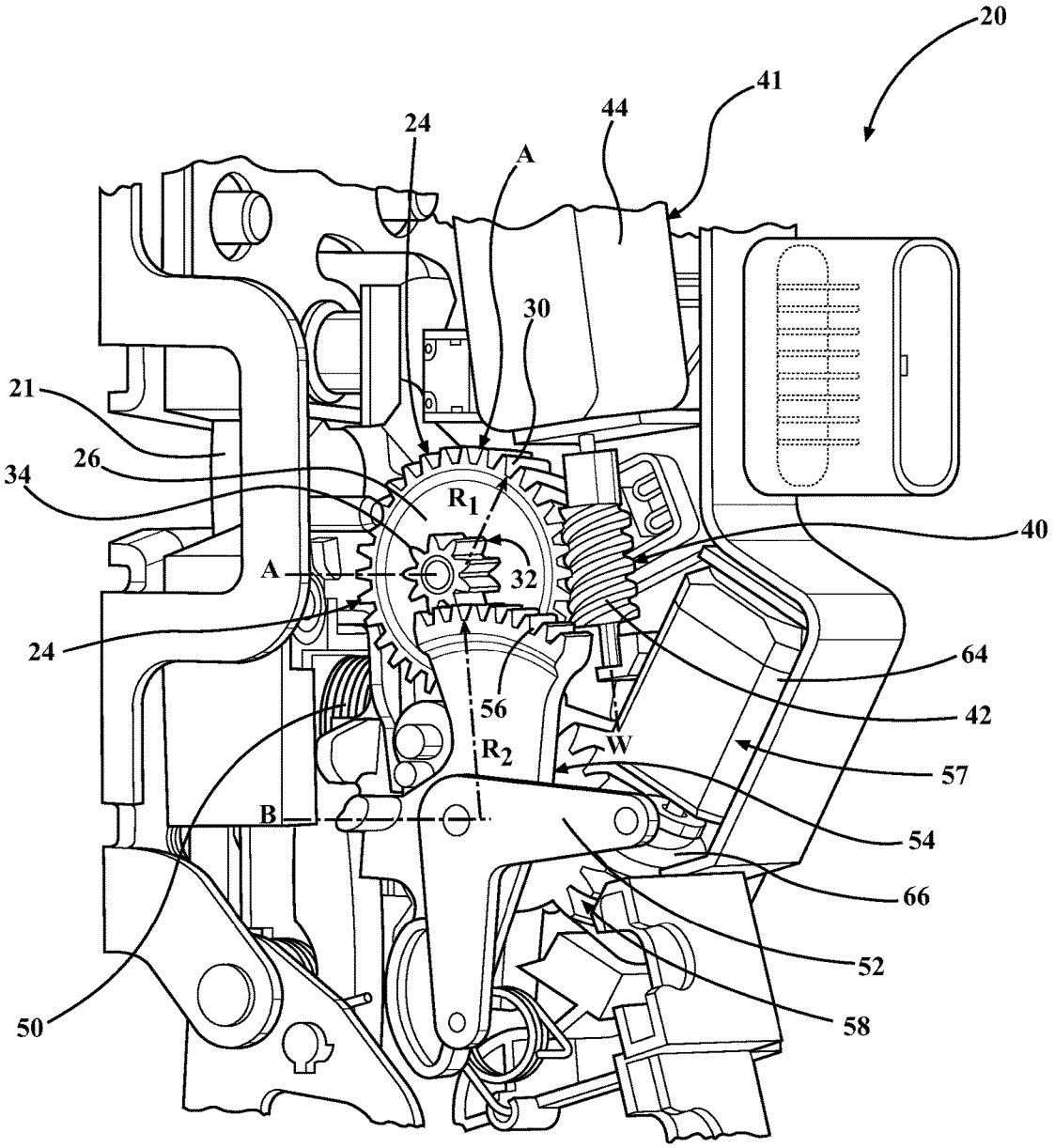
Figure 3A:
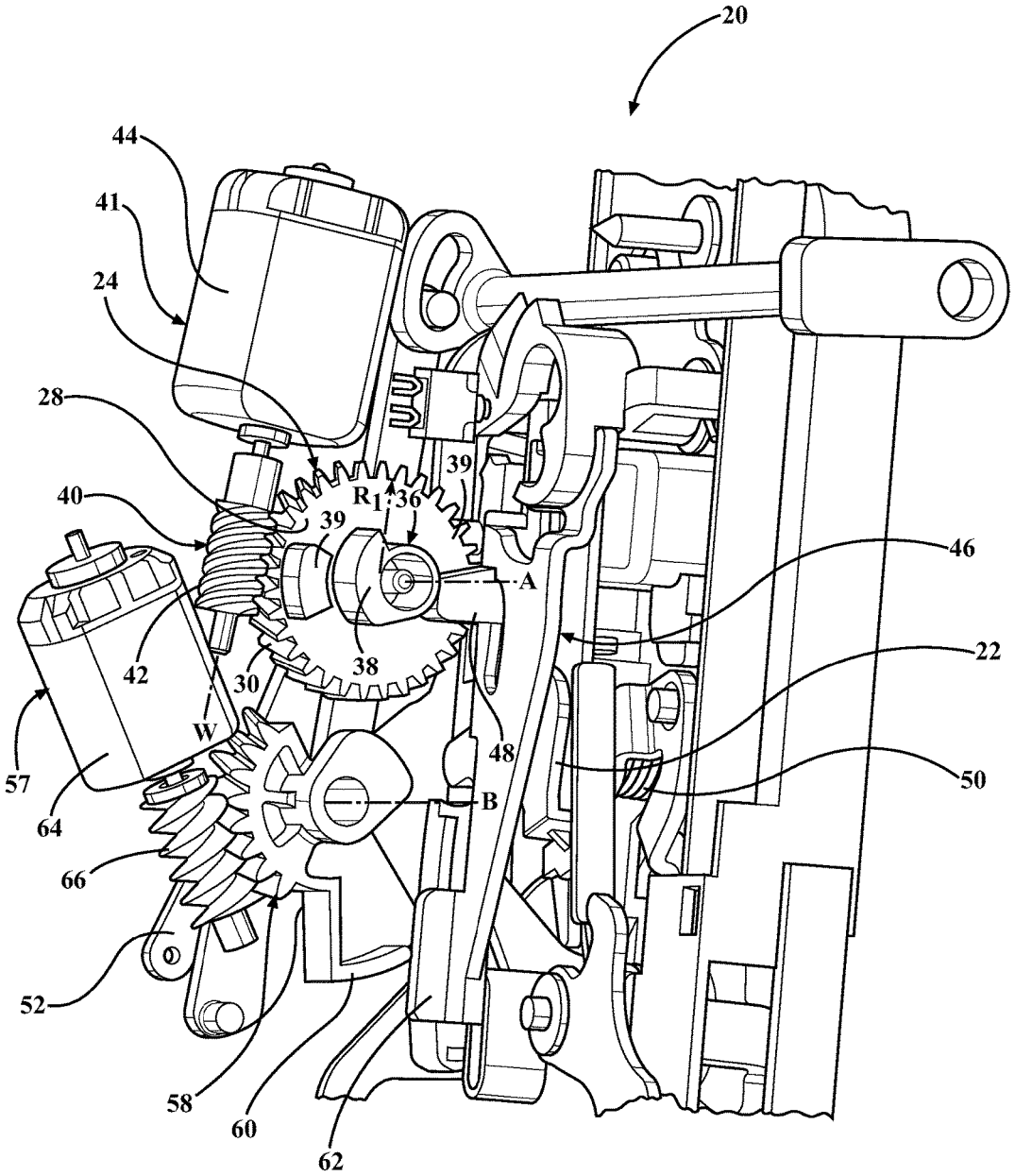
Figure 3B:
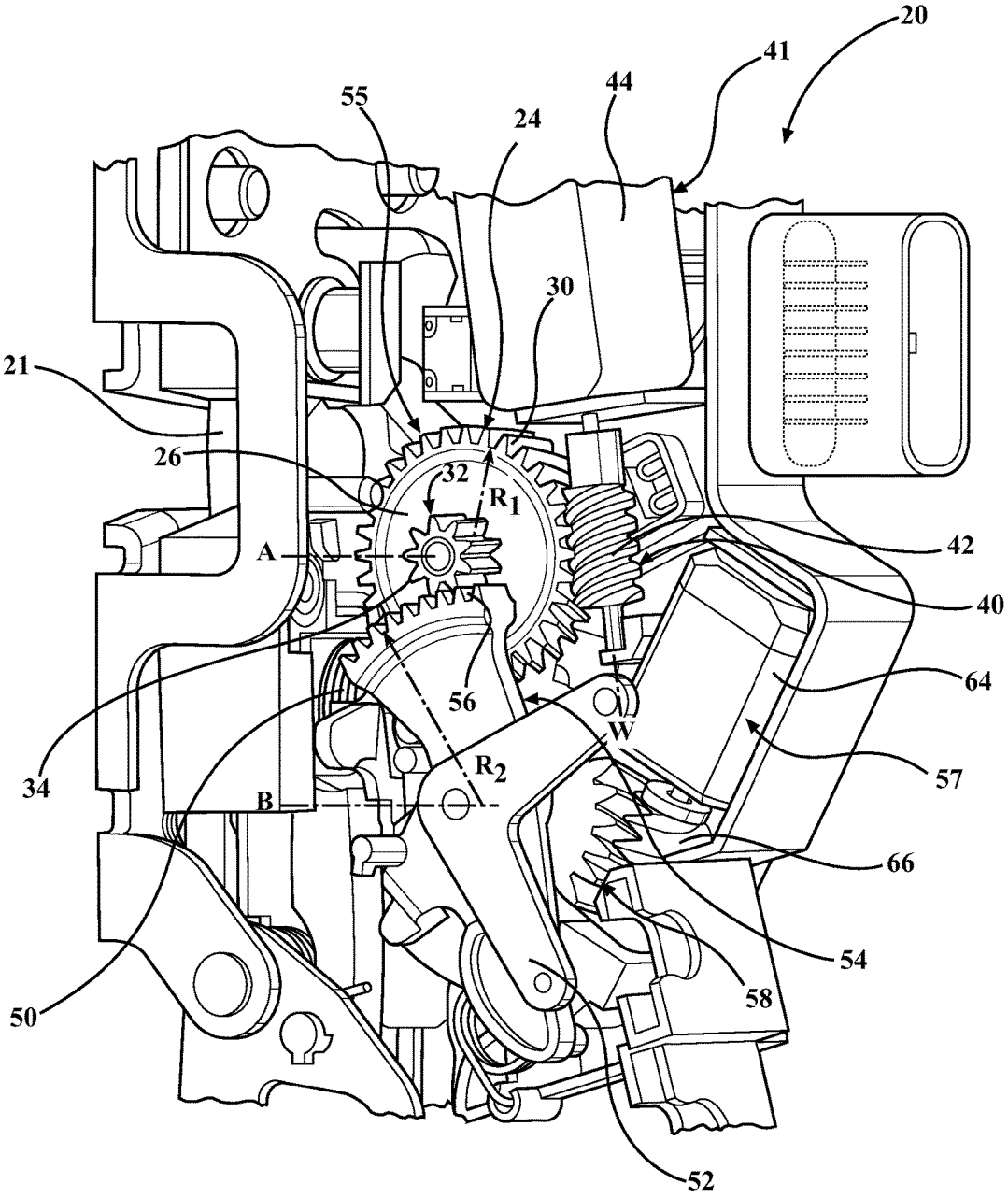
Figure 4A:
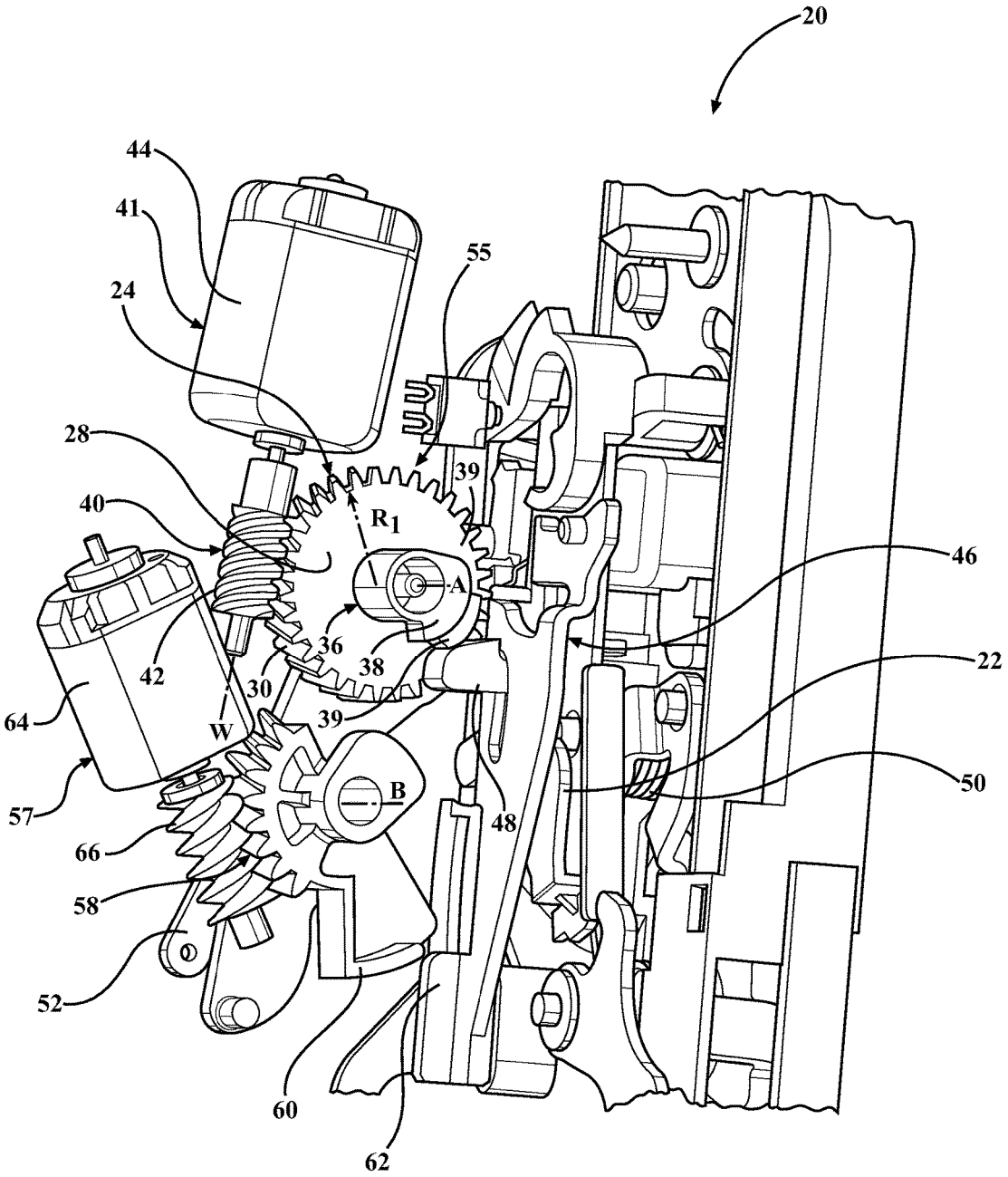
Figure 4B:
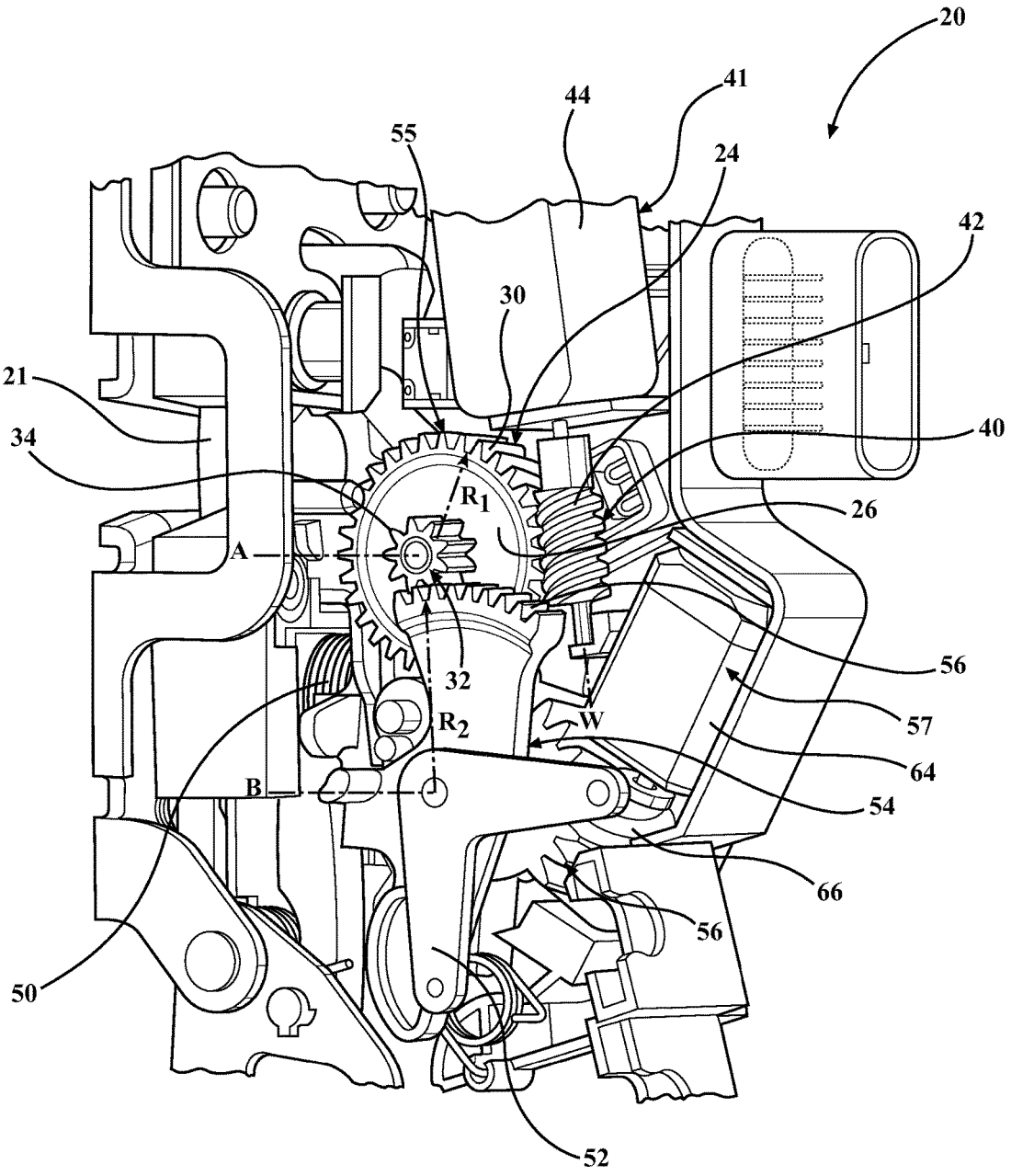

FIGS. 3A and 3B are perspective views of the latch assembly of FIGS. 1A and 1B, showing the intermittent link in an unlocked position, the lock link in an unlocking position, and the inside lock lever moving toward a door unlock position; and FIGS. 4A and 4B are perspective views of the latch assembly of FIGS. 1A and 1B, showing the intermittent link in a lock position, the lock link in a locking position, and the inside lock lever in the door lock position.

DESCRIPTION OF EXAMPLE EMBODIMENTS

Example embodiments will now be described more fully with reference to the accompanying drawings. Each of the example embodiments is directed to a latch assembly for use on a vehicle. The example embodiments only are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Referring to the Figures, a closure latch assembly 20 for a vehicle door is generally shown in FIGS. 1A-4B. The latch assembly 20 is typically associated with a ratchet 21 movable between an open position (best shown in FIG. 1B) and a closed position (best shown in FIG. 2B) and biased towards the open position. The latch assembly 20 is also typically associated with a pawl (not shown) movable between a ratchet locking position wherein the pawl holds the ratchet 21 in the closed position, and a ratchet release position wherein the pawl permits the ratchet 21 to move to the open position, thus allowing the vehicle door to be opened. The pawl is biased towards the ratchet locking position. An outside door release lever (not shown) is typically operatively connected to the ratchet 21 and the vehicle door. The outside door release lever is movable between a home position and an actuated position and is biased towards the home position. An example of the ratchet, pawl, and door release lever is disclosed in International Patent Application Publication No. WO 2009/046539.

The latch assembly 20 includes a lock link 22 that is linearly movable between an unlocking position (best shown in FIG. 2*a*) and a locking position (best shown in FIG. 4*a*) for allowing movement of the ratchet 21 and pawl in response to movement of the outside door release lever between the home position and the actuated position. The ratchet 21, which is operatively connected to the outside door release lever and the pawl, is driven to the ratchet release position in response to movement of the outside door release lever to the actuated position when the lock link 22 is positioned in the unlocking position. On the other hand, when the lock link 22 is positioned in the locking position, the outside door release lever is disconnected from the pawl, and thus movement of the outside door release lever to the actuated position does not cause any movement of the pawl.

The latch assembly 20 further includes a first stage gear 24 that is rotatable about a first axis A and has a first side 26 and a second side 28 spaced axially from the first side 26. The first stage gear 24 further includes an outer periphery at a first radius $R_1$ and presents a plurality of pitched teeth 30 disposed between the first and the second side 26, 28. The first stage gear 24 also includes a protrusion 32 that extends axially from the first side 26 and defines a plurality of non-pitched teeth 34 that extend radially therefrom. The protrusion 32 defines a protrusion radius $R_P$ (best shown in FIG. 1B) that is smaller than the first radius $R_1$. The first stage gear 24 further includes a cylindrical projection 36 that extends axially from the second side 28 and is disposed about the first axis A. The projection 36 has an overhang 38 that extends radially from the cylindrical projection 36. Furthermore, a gear tab 39 extends from the second side 28 of the first stage gear 24 adjacent to the outer periphery of the first stage gear 24.

The latch assembly 20 further includes an actuator 41 for driving the first stage gear 24. The actuator 41 includes a worm gear 40 that is rotatable about a worm axis W that is generally perpendicular to the first axis A. The worm gear 40 is generally cylindrical in shape and has worm teeth 42 spirally disposed therealong. The worm teeth 42 engage the pitched teeth 30 of the first stage gear 24 for causing rotation of the first stage gear 24 as the worm gear 40 is rotated about the worm axis W. The actuator 41 also includes a power lock motor 44 that is attached to the worm gear 40 for rotating the worm gear 40. It should be appreciated that the power lock motor 44 could be connected to the first stage gear 24 in other ways. For example, the power lock motor 44 could be directly connected to the first stage gear 24 along the first axis A or other types of gears other than a worm gear could be utilized without departing from the scope of the subject disclosure.

An intermittent link 46 is linearly movable between a lock position (best shown in FIG. 4A) and an unlocked position (best shown in FIG. 2A) and includes a protuberance 48 for engaging the gear tab 39 of the first stage gear 24 as well as a flange 62 that is spaced from the protuberance 48. A comfort spring 50 engages the intermittent link 46 for biasing the intermittent link 46 in the unlocked position. The intermittent link 46 attaches to and engages the lock link 22 for moving the lock link 22 between the locking position and the unlocking position as the gear tab 39 moves with the protuberance 48 and causes linear movement of the intermittent link 46 and the lock link 22. As soon as the lock link 22 moves to the unlocking position with the gear tab 39 out of alignment with the protuberance 48, the user or impatient user is able to open the door, even before the other components of the latch assembly 20 move to their respective unlocking positions. The overhang 38 of the first stage gear 42 engages and guides the protuberance 48 in the axial direction during the linear movement of the intermittent link 46.

The latch assembly 20 also includes an inside lock lever 52 that is rotatable between a door lock position (best shown in FIG. 2B) and a door unlock position (best shown in FIG. 3B) for mechanical connection to a locking mechanism disposed on the vehicle door and operated from inside the vehicle (e.g., door lock knob disposed on the inside of the vehicle door). A second stage gear 54 is attached to the inside lock lever 52 and is rotatable about a second axis B that is generally parallel to the first axis A. The second stage gear 54 also defines a plurality of drive teeth 56 that engage the non-pitched teeth 34 of the first stage gear 24. The second stage gear 54 has a second radius $R_2$ that is larger than the first radius $R_1$. The second stage gear 54 causes rotation of the inside lock lever 52 about the second axis B as the first stage gear 24 rotates about the first axis A and causes rotation of the second stage gear 54 about the second axis B. In the example embodiment, the second stage gear 54 is a sector gear, however, other types of gears could be utilized without departing from the scope of the subject disclosure.

In accordance with the above, a transfer assembly 55 that interconnects the lock and intermittent links 22, 46 is defined by the first stage gear 24 and the second stage gear 54. It should be appreciated that since the second radius $R_2$ of the second stage gear 54 is larger than the first radius $R_1$ of the first stage gear 24, the first stage gear 24 rotates at a higher speed and with lower torque than the second stage gear 54. Correspondingly, the second stage gear 54 rotates at a lower speed and with higher torque than the first stage gear 24.

The torque and speed relationship between the first and second stage gears 24, 54 allows the intermittent link 46 to quickly be moved to the unlocked position since the gear tab 39 of the first stage gear 24 almost immediately moves out of the way of the intermittent link 46 as soon as the actuator 41 is actuated. This advantageously occurs while the second stage gear 54 provides the necessary torque to move the inside lever 52, which requires a relatively large force to move. More specifically, the movement of the inside lock lever 52 to the door unlock position generally requires more torque than that required to move the lock link 22 to the unlocking position, and thus takes longer than the movement of the lock link 22. However, since the user or the impatient passenger is able to open the door handle as soon as the lock link 22 reaches the unlocking position, the amount of time it takes for the inside lock lever 52 to reach the door unlock position is less important. Accordingly, a single, relatively small power lock motor 44 can be used in the latch assembly 20. The power lock motor 44 only needs to produce a fraction of the torque that would otherwise be required if the intermittent link 46 were required to be moved completely and simultaneously with the inside lock lever 52.

The ability to use a single, smaller power lock motor 44 is at least partially due to the gear ratios of the first and second stage gears 24, 54 provided by the difference between the first, second, and protrusion radiuses $R_1$, $R_2$, $R_P$ of the first and second stage gears 24, 54, as well as the radial position of the gear tab 39. More specifically, because of the smaller first radius $R_1$, and the radial location of the gear tab 39 as related to the first radius $R_1$ of the first stage gear 24, the first stage gear 24 may be rotated only a small fraction (e.g. 30 degrees in the enabling embodiment) of its full travel before causing the intermittent link 46 to move to the unlocked position. On the other hand, the inside lock lever 52 remains in the lock position until the first stage gear 24 is further rotated (e.g. 200 degrees in the enabling embodiment) causing further rotation of the protrusion 32 and second stage gear 54 which moves the inside lock lever 52 to the unlock position. This delay is provided by the larger radius $R_2$ of the second stage gear 54 and the smaller protrusion radius $R_P$ of the first stage gear 24 which provides increased torque.

The latch assembly further includes a supplemental locking assembly 57. The supplemental locking assembly 57 includes a secondary sector gear 58 that is rotatable about the second axis B between a spaced position and a double-lock position. An extension 60 extends from the secondary sector gear 58 for engaging the flange 62 on the intermittent link 46 when the secondary sector gear 58 is in the double-lock position for preventing linear movement of the intermittent link 46 from the locking position. The supplemental locking assembly 57 further includes a secondary motor 64 and supplemental gear 66 that is driven by the secondary motor 64 and meshed with the secondary sector gear 58 to provide rotational movement to the secondary sector gear 58 between the spaced and double-lock positions. It should be appreciated that positioning the secondary sector gear 58 in the double-lock position provides supplemental safety locking feature to further prevent the lock and intermittent links 22, 46 from moving when it is desired for the vehicle to be locked. It should further be appreciated that the latch assembly 20 could be constructed without the supplemental locking assembly 57.

It should be appreciated that the term "gear" as used herein could encompass conventional gears that utilize teeth or other frictional engagement members that do not include teeth.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varies in many ways. Such variations are not to be regarded as a departure from the disclosure, and all such modifications are intended to be included within the scope of disclosure.

What is claimed is:

1. A latch assembly for use with a striker and a lock knob assembly within a vehicle, the latch assembly comprising:

a ratchet moveable between a closed position in which the striker is retained within the ratchet and an open position in which the ratchet releases the striker from the ratchet;

a lock link operatively coupled to said ratchet and being movable between a locking position holding said ratchet in said closed position and an unlocking position allowing said ratchet to move to said open position;

an inside lock lever operatively coupled to said ratchet and moveable between a door lock position and a door unlock position for connecting to the lock knob assembly for moving the lock knob assembly and the ratchet in response to rotation of said inside lock lever;

an intermittent link configured for movement between a locked position and an unlocked position and to engage said lock link for moving said lock link between said locking position and said unlocking position;

a transfer assembly interconnecting said lock link and said inside lock lever and including a first gear and a second gear operably connected to said inside lock lever, said first gear having a first side and a second side and being rotatable about a first axis, wherein a protrusion extends from said first side of said first gear along said first axis for engagement with said second gear to rotatably drive said second gear in response to rotation of said first gear, and wherein a gear tab extends from said second side of said first gear for engagement with said intermittent link to cause said movement of said intermittent link between said locked position and said unlocked position and to move said lock link between said locking position and said unlocking position;

wherein said second gear rotates about a second axis extending parallel to said first axis; and further including an actuator operatively coupled to said first gear and said second gear for providing rotational movement to both of said first gear and said second gear with a plurality of teeth disposed between said first side and said second side of said first gear, said actuator includes a motor and a worm gear connected to said motor and rotatable about a worm axis, and said worm gear presents a plurality of worm teeth spirally disposed therealong and engaging said plurality of teeth of said first gear for causing rotation of said first gear as said worm gear is rotated about said worm axis.

2. A latch assembly as set forth in claim 1 wherein said actuator engages said first gear to provide rotating movement to said first gear, and said second gear engages said first gear to provide rotational movement to said second gear in response to said rotational movement of said first gear.

3. A latch assembly as set forth in claim 1 wherein said protrusion has a cylindrical shape.

4. A latch assembly as set forth in claim 3 wherein said protrusion has a protrusion radius being smaller than an outer radius of said first gear.

5. A latch assembly as set forth in claim 1 wherein said worm axis extends perpendicularly to said first axis and said second axis.

6. A latch assembly as set forth in claim 1 wherein a plurality of teeth extend radially from said protrusion and are spaced circumferentially about said protrusion, and said second gear presents a plurality of drive teeth engaging said plurality of teeth of said protrusion for causing rotation of said inside lock lever about said second axis as said first gear rotates about said first axis and causes rotation of said second gear about said second axis.

7. A latch assembly as set forth in claim 1 further including a biasing member biasing said intermittent link toward said unlocked position, and said intermittent link presents a protuberance for engaging said gear tab of said first gear for holding said intermittent link in said locked position until said first gear has rotated a predetermined distance to move said protuberance out of alignment with said gear tab.

8. A latch assembly as set forth in claim 7 further including a projection extending from said second side of said first gear, and said projection includes an overhang for engaging and guiding said protuberance during said movement of said intermittent link.

9. A latch assembly for use with a striker and a lock knob assembly within a vehicle, the latch assembly comprising:

a ratchet moveable between a closed position in which the striker is retained within the ratchet and an open position in which the ratchet releases the striker from the ratchet;

a link operatively coupled to said ratchet and movable between a lock position holding said ratchet in said closed position and an unlocked position allowing said ratchet to move to said open position;

an inside lock lever operatively coupled to said ratchet and moveable between a door lock position and a door unlock position for connecting to the lock knob assembly for moving the lock knob assembly and the ratchet in response to rotation of said inside lock lever; and a transfer assembly interconnecting said link and said inside lock lever and including a first gear being rotatable and having a first radius and connected to said link for providing said movement of said link, and a second gear rotatable and having a second radius and connected to said inside lock lever for providing said movement of said inside lock lever, and wherein said second radius of said second gear is larger than said first radius of said first gear for rotating said first gear at a higher speed and with lower torque than said second gear to quickly move the link and for rotating said second gear at a lower speed and with higher torque than said first gear to forcefully move said inside lock lever;

an actuator operatively coupled to said first gear and said second gear for providing rotational movement to both of said first gear and said second gear, wherein said first gear has a first side and a second side and rotates about a first axis, a protrusion extends from said first side of said first gear along said first axis, and said second gear engages said protrusion for providing rotational movement to said second gear in response to said rotational movement of said first gear; and wherein a gear tab extends axially from said second side of said first gear from a position being radially outwardly from said first axis for engaging said link for transmitting movement from said first gear to said link.

10. A latch assembly as set forth in claim 9 further including a biasing member biasing said link toward said unlocked position, and said link presents a protuberance for engaging said gear tab of said first gear for holding said link in said locked position until said first gear has rotated a predetermined distance to move said protuberance out of alignment with said gear tab.

11. A latch assembly as set forth in claim 10 further including a projection extending from said second side of said first gear, and said projection includes an overhang for engaging and guiding said protuberance during said linear movement of said link.

12. A latch assembly as set forth in claim 11 wherein said projection has a generally cylindrical shape and extends along said first axis.

13. A latch assembly for use with a striker and a lock knob assembly within a vehicle, the latch assembly comprising:

a ratchet moveable between a closed position in which the striker is retained within the ratchet and an open position in which the ratchet releases the striker from the ratchet;

a lock link operatively coupled to said ratchet and being movable between a locking position holding said ratchet in said closed position and an unlocking position allowing said ratchet to move to said open position;

an inside lock lever operatively coupled to said ratchet and moveable between a door lock position and a door unlock position for connecting to the lock knob assembly for moving the lock knob assembly and the ratchet in response to rotation of said inside lock lever;

an intermittent link configured for movement between a locked position and an unlocked position and to engage said lock link for moving said lock link between said locking position and said unlocking position; and a transfer assembly interconnecting said lock link and said inside lock lever and including a first gear and a second gear operably connected to said inside lock lever, said first gear having a first side and a second side and being rotatable about a first axis, wherein a protrusion extends from said first side of said first gear along said first axis for engagement with said second gear to rotatably drive said second gear in response to rotation of said first gear, and wherein a gear tab extends from said second side of said first gear for engagement with said intermittent link to cause said movement of said intermittent link between said locked position and said unlocked position and to move said lock link between said locking position and said unlocking position, and wherein said lock link is linearly moveable between said unlocking position and a locking position for allowing movement of said ratchet in response to movement of an outside door release lever of the vehicle and wherein said intermittent link is connected to said lock link for providing said linear movement of said lock link in response to rotational movement of said first gear.

* * * * *